United States Patent [19]

Peltier

[11] Patent Number: 4,809,895

[45] Date of Patent: Mar. 7, 1989

[54] PISTOL HOLSTER AND MOUNTING BRACKET

[76] Inventor: Michael J. Peltier, 15706 Maddelein, Detroit, Mich. 48205

[21] Appl. No.: 122,214

[22] Filed: Nov. 18, 1987

[51] Int. Cl.[4] ..... A45F 5/00

[52] U.S. Cl. ..... 224/253; 224/243; 224/911

[58] Field of Search ..... 224/193, 238, 243, 253, 224/911, 912

[56] References Cited

U.S. PATENT DOCUMENTS

| | | | |
|---|---|---|---|
| 1,295,831 | 3/1919 | Alderson | 224/193 |
| 1,629,700 | 5/1927 | Harter | 224/911 |
| 3,197,098 | 7/1965 | Clark | 224/253 |
| 3,642,183 | 2/1972 | Boren | 224/911 |
| 3,749,293 | 7/1973 | Bianchi | 224/193 |
| 3,902,639 | 9/1975 | Rogers | 224/193 |
| 3,955,724 | 5/1976 | Perkins | 224/243 |
| 4,101,060 | 7/1978 | Bianchi et al. | 224/911 |

*Primary Examiner*—Henry J. Recla
*Assistant Examiner*—Linda J. Sholl
*Attorney, Agent, or Firm*—Charles J. Prescott

[57] ABSTRACT

An improved holster for a handgun, the holster generally of the type having a holster hanger adapted to interengage with, and be supported by, the user's waistband or belt. The improvement is generally directed to increasing the length and width of the slot between the holster body and hanger for receiving the skirt portion of a jacket, coat, shirt or the like. This feature enhances ready access to the handgun, while also reducing "bunching" of the skirt in otherwise shorter and narrower slots found in conventional holsters. Further benefits of this invention are related to providing a smooth, uninterrupted surface for both surfaces of the holster hanger and body, reducing clothing and handgun wear. These improvements result from a novel structure and arrangements for interconnecting the holster hanger to the inner side of the holster body itself. A further refinement of this novel structure incorporates rigid yet resilient structure to be incorporated into the holster body and integral with the inner stiffening portion holster hanger which facilitates front exiting of the handgun from the holster body.

7 Claims, 3 Drawing Sheets

Fig. 5
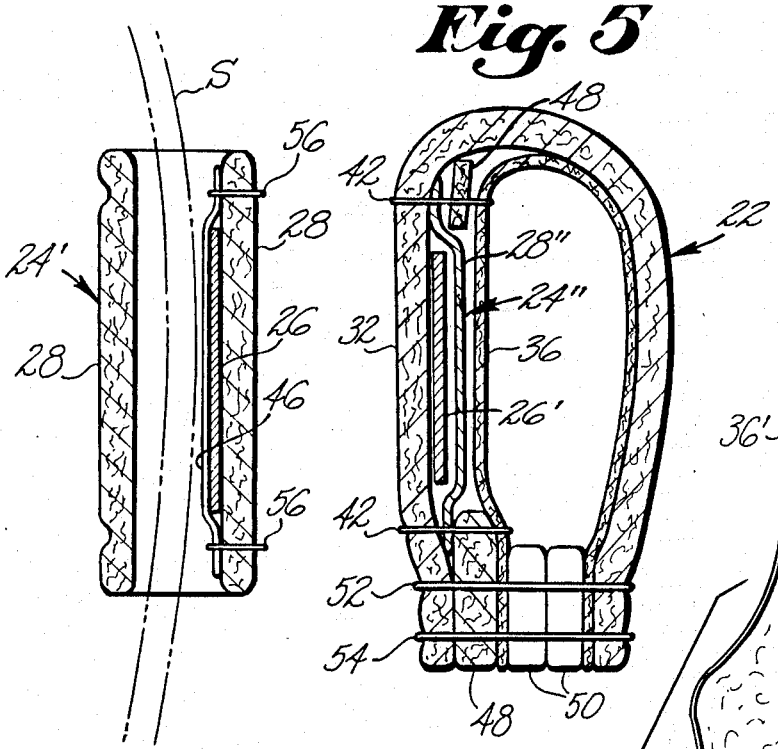
Fig. 4
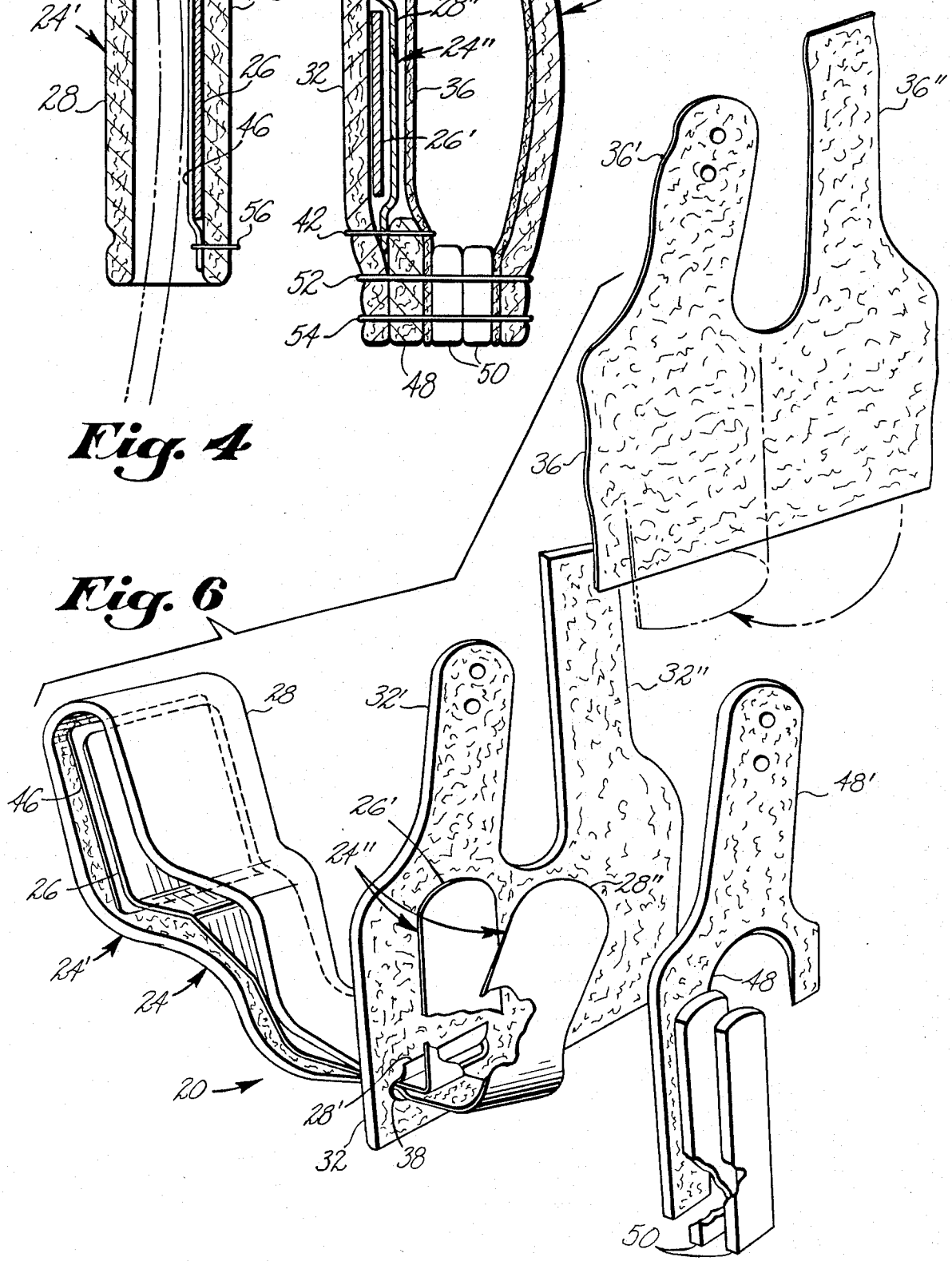
Fig. 6

PISTOL HOLSTER AND MOUNTING BRACKET

BACKGROUND OF THE INVENTION

This invention relates generally to holsters designed to be connectable to a user's waistband, belt or the like, and more particularly to an improved holster having an extended outer garment skirt receiving slot.

Holsters worn by law enforcement officers and security personnel are commonly attached to a belt worn around the user's waist to hold the holster in close proximity to the body and to render the handgun held therein in ready position for use. Many of these users wear uniforms, particularly in colder weather, which extend downwardly below the level of the belt and, therefore, partially conceal the handgun and/or inhibit its access.

Prior art discloses holsters which provide holster hangers which interengage to the user's belt. One such holster is disclosed in U.S. Pat. No. 3,197,098 to Clark, while others are disclosed in two U.S. Pat. Nos. 4,101,060 and 3,749,293 to Bianchi. An additional pivotal design between holster and hanger is disclosed in U.S. Pat. No. 3,955,724 to Perkins.

Although all of these references variously provide limited space between holster hanger and holster body to receive the skirt of the elongated outer garment, the slot therebetween nonetheless is somewhat lacking in depth because of the required structure of the above prior art references to facilitate sufficiently strong interengagement between holster hanger and holster body to support a handgun in day-in-day-out use. Additionally, all of the references disclosed above variously include fasteners such as rivets and threaded bolts for interengagement between these members which accelerate wear against the user's pant legs and upper clothing, as well as producing abusive wear to the seating in squad cars. The localized stress produced by rivets and the like, even when coupled with associated peripheral stitching, produces premature deterioration of the connection between holster hanger and holster body.

Further disclosed in the '293 and '060 patents to Bianchi are structures for facilitating removal of a handgun by forwardly movement of the grip of the handgun whereby the handgun exits from the holster through the front opening thereof. The Bianchi references, along with the disclosure in U.S. Pat No. 3,865,289, all disclose front exiting holster bodies which are variously retained in their closed position by the spring biasing action of a length of formed wire imbedded within the layers of flexible material forming the holster body and adjacent the front opening.

The present invention provides a novel holster assembly having an improved structure and means for attaching the holster hanger to the holster body, thus providing an elongated and widened slot for receiving the skirt of upper garments such as jackets, shirts, coats and the like, while also providing a smooth, uninterrupted surface for both holster hanger and inner side of the holster itself. By this invention, then, clothing, handgun and vehicle seat wear are reduced substantially by providing the smooth interrupted surfaces thereagainst and ready access to the handgun is increased while also reducing the "bunching" of the skirt in the slot between holster and holster body. An alternate embodiment of the invention further provides for an improved and integral structure combining the rigid portion of the improved holster hanger and resilient means for the holster body for facilitating front release of the handgun from the holster body itself.

BRIEF SUMMARY OF THE INVENTION

This invention is directed to an improved holster for a handgun, the holster generally of the type having a holster hanger adapted to interengage with, and be supported by, the user's waistband or belt. The improvement is generally directed to increasing the length and width of the slot between the holster body and hanger for receiving the skirt portion of a jacket, coat, shirt or the like. This feature enhances ready access to the handgun, while also reducing "bunching" of the skirt in otherwise shorter and narrower slots found in conventional holsters. Further benefits of this invention are related to providing a smooth, uninterrupted surface for both surfaces of the holster hanger and body, reducing clothing and handgun wear. These improvements result from a novel structure and means for interconnecting the holster hanger to the inner side of the holster body itself. A further refinement of this novel structure incorporates rigid yet resilient structure to be incorporated into the holster body and integral with the inner stiffening portion of holster hanger which facilitates front exiting of the handgun from the holster body.

It is therefore an object of this invention to provide an improved holster for a handgun which is more readily adapted to receive the skirt portion of upper garments such as jackets, coats, shirts and the like to both reduce "bunching" thereof and to increase the ready access to the handgun.

It is another object of this invention to reduce wear of both the user's clothing and the handgun carried in the holster.

It is yet another object of this invention to provide improved structure and means for interconnection between the holster hanger and the holster body itself, satisfying the above objects as well as providing enhanced durability of the holster.

It is yet another object of this invention to facilitate the higher positioning of the holster body in relation to the waistband or belt of the user while still facilitating receipt of the skirt portion of the upper garments without interference with ready access to the handgun.

It is yet another object of this invention to provide an integrally formed, rigid substructure for the holster hanger which also provide resilient reinforcing means for facilitating a holster body having a forwardly exiting slot for the handgun therefrom.

In accordance with these and other objects which will become apparent hereinafter, the instant invention will now be described with reference to the accompanying drawings in which:

BRIEF DESCRIPTION OF THE DRAWINGS

FIG. A is a side elevation view of a prior art holster assembly having an attached holster hanger which provides a foreshortened narrowing upper garment skirt slot.

FIG. B is an enlarged front elevation partially broken section view of FIG. A.

FIG. 4 is a section view in the direction of arrows 4—4 in FIG. 3.

FIG. 5 is a section view in the direction of arrows 5—5 in FIG. 3.

FIG. 6 is an exploded perspective view of the assembly of the invention as shown in FIGS. 1–5.

DETAILED DESCRIPTION OF THE INVENTION

Prior Art

Figure 8:
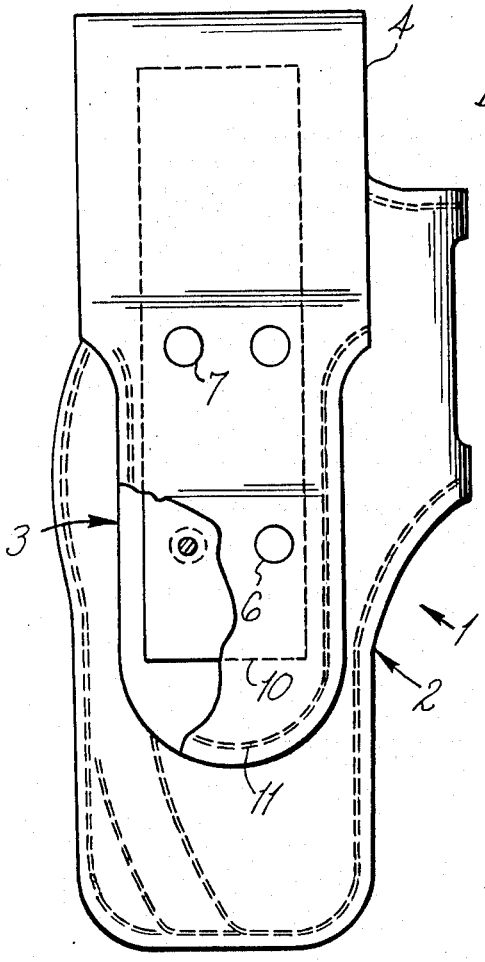
FIG. 8 is a perspective view of an alternate embodiment of the holster hanger stiffener.
Figure 8:
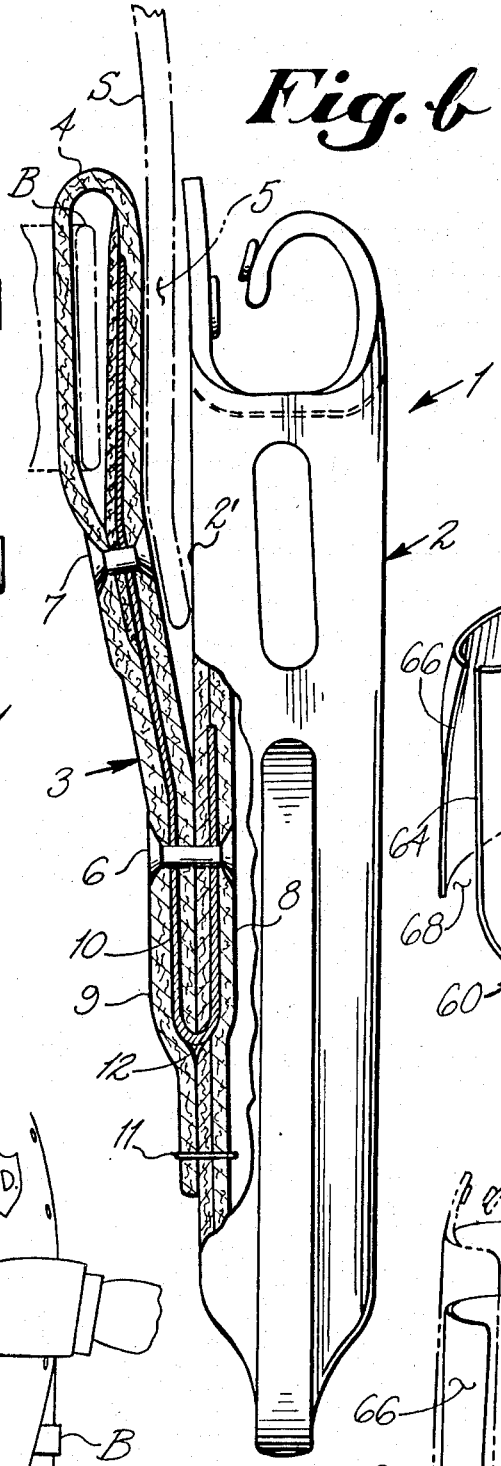
Figure 8:
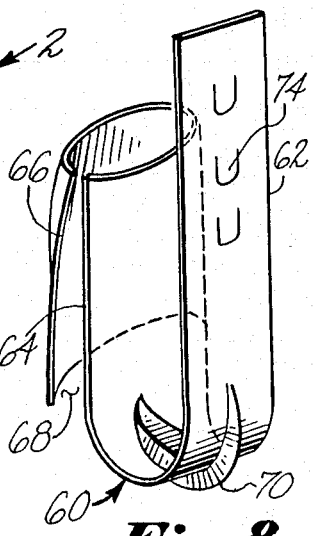

Referring initially to FIGS. A and B, the holster assembly shown generally at 1 generally represents presently available holster body 2/holster hanger 3 structure and associated upper garment skirt S receiving slot 5. The slot 5 extends from the upper portion of the holster assembly 1 to a point midway along the length of the holster body 2 at which point the slot 5 diminishes and tapers to its lower end at that point. In this embodiment 1 of the prior art known to applicant, as disclosed in U.S. Pat. No. 3,642,183, a novel structure for interengaging the holster hanger 3 to the holster body 2 is also disclosed. As therein disclosed, and based upon a thorough inspection of a production sample thereof, a rigid metallic strap 10 is embedded within a surrounding layer of non-metallic flexible material 9 (leather in sample) which facilitates the passing of the lower end of the rigid strap 10 through an opening 12 in the inner side 2' of the holster body 2 and between the inner layer 8 and the outer layer 2' as best shown in FIG. B. However, to provide sufficient structure for interengagement of the holster hanger 3 to the inner side 2', both rivets 6 and stitching 11 are incorporated for this function above the opening 12, reducing the length of the slot 5, coupled with substantial material below the slot 12. Additionally, rivets 7 are also required to secure the flexible outer strap 9 around and against the inner rigid strap 10 and to assist in forming the belt loop 4 designed to receive and be supported by the user's waistband or belt B.

The Invention

Figure 1:
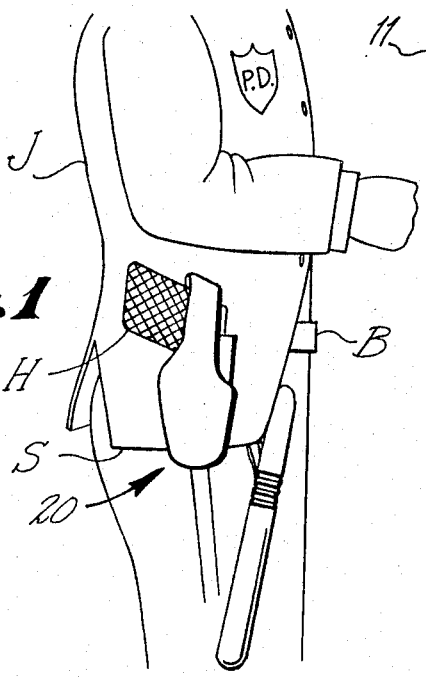
FIG. 1 is a pictorial view of the preferred embodiment of invention in use.

Referring now to FIG. 1, the preferred embodiment of the invention is shown generally at 20 shown in pictorial fashion attached to the belt B of a user such as a police officer or security guard. The handgun H is secured locked within the holster assembly 20 and is positioned in sufficiently high fashion in relation to the belt B that the officer may conveniently get in and out of an automobile and otherwise have the handgun H positioned relatively high in relation to belt B for improved access. Even in this elevated configuration, it is important to note that the skirt S of the user's jacket J downwardly extends between the handgun H and holster body and the belt B and other clothing without "bunching" or inhibiting access to the handgun H.

Referring now also to FIGS. 2 through 7, the preferred embodiment of the holster assembly 20 is shown to include a holster body 22 and a holster hanger 24. As best seen in FIG. 6, the holster body 22 generally includes flexible first outer layer having inner side wall 32 and upper extending portions 32' and 32'' and also having elongated transversely disposed opening 38 through inner side wall 32 adjacent the lower margin thereof. The holster body 22 also includes an intermediate layer 48 having portion 48' which mates against upper portion 32' as will be herebelow described. Further included in the holster body 22 are spacer strips 50 which generally mate in profile with the lower extending leg of second flexible inner sheet 48 as shown. Finally, a second inner layer 36 is provided which, when folded along L, adheres in place to form a smooth surface against the handgun H.

Figure 3:
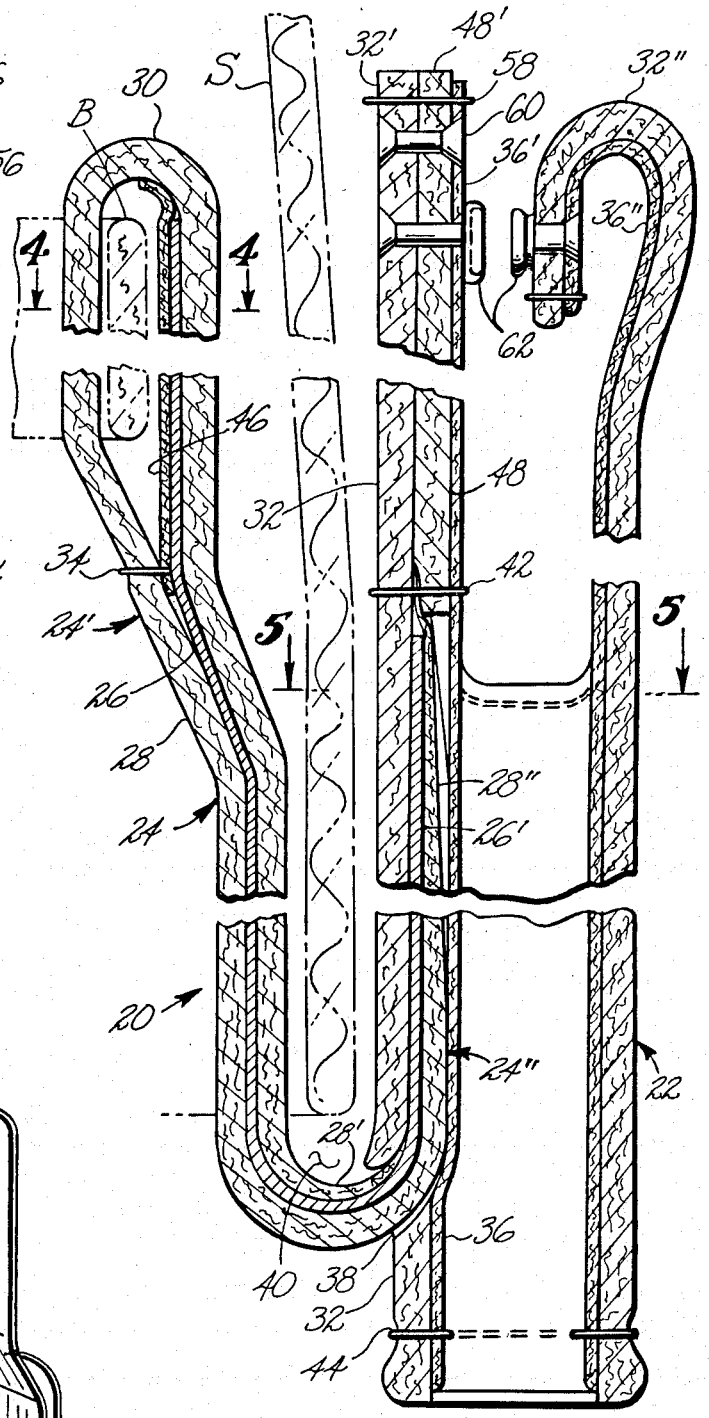
FIG. 3 is an enlarged section view in the direction of arrows 3—3 in FIG. 2.
Figure 7:
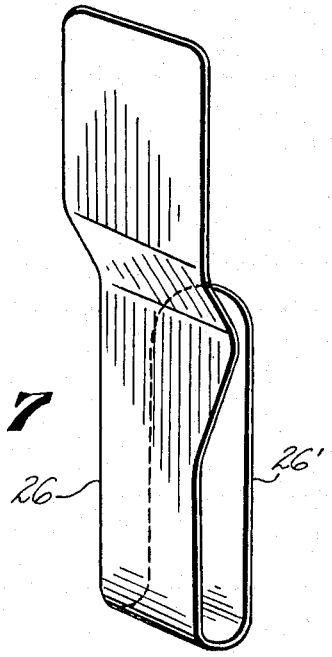
FIG. 7 is a perspective view of the holster hanger stiffener shown in FIGS. 1–5.

The holster hanger 24 generally includes a rigid formed stiffener 26 and a flexible cover 28 secured therearound. The holster hanger 24 generally has a U-shaped cross section as best seen in FIGS. 3 and 7 and may be generally described as having a first exposed portion 24' and a second concealed portion 24''. The flexible cover 28 extends over the inner surface of stiffener 26 beginning at 28' at the bottom of the U-cross section extending upwardly to form belt loop 30 as will be herebelow described, then extending downwardly along the outer surface of stiffener 26 and then upwardly along the outer surface of the opposing leg of stiffener 26 at 28''. The cover 28 is held in the position as hereabove described along the first exposed portion 24' of hanger 24 by both glueing or adhering the mating surfaces together and by stitching along 56 such that stiffener 26 is generally encapsulated by cover 28 except in the area of the belt loop 30 which further structure there will be herebelow described.

Figure 2:
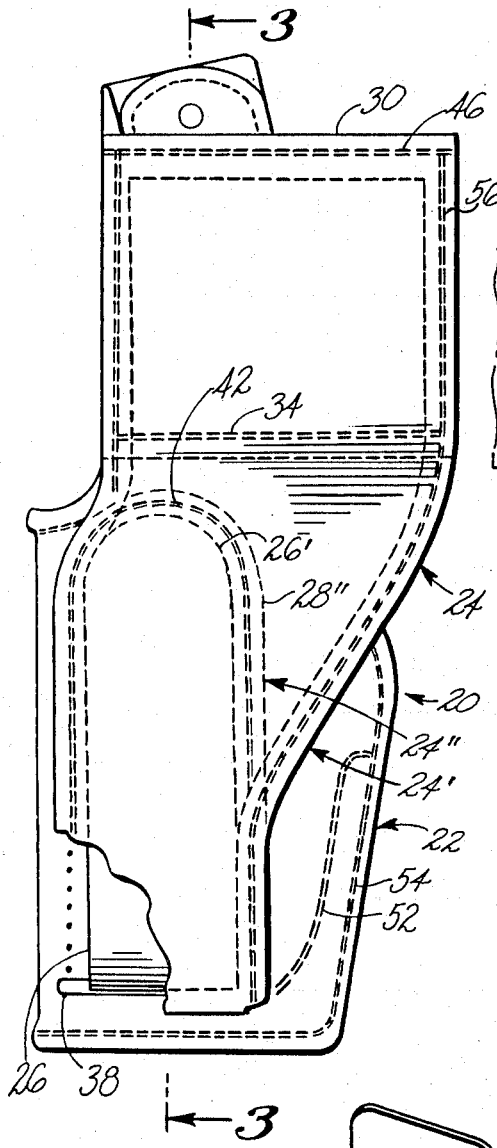
FIG. 2 is a side elevation view in partially broken section of the invention shown in FIG. 1.

Referring particularly to FIGS. 2, 3 and 4, with regard to the formation of the belt loop 30, panel 46 is provided to be adhered and stitched along 56 and along 34 to be secured as shown extending to the upper portion of the belt loop 30. In positioning and contouring that segment of cover 26, sufficient gap is provided, as best seen in FIG. 3, to accommodate the user's belt B or the like passed therethrough which secures the entire holster assembly 20 at the user's side as shown in FIG. 1.

Referring particularly to FIGS. 2, 3, 5 and 6, the structure for interengagement between the holster hanger 24 and holster body 22 will now be described in detail. The section portion 24'' of holster hanger 24, including stiffener portion 26' and cover portion 28'', extends into the transverse opening 38 formed in the outer side panel 32 as previously described. The concealed cover portion 28'' is preferably tapered in cross section down to a wedge at its distal end and is somewhat longer and wider than stiffener portion 26' so that, when in proper position, stitching along 42 will surround the second stiffener portion 26' as best seen in FIG. 2.

Prior to assembling the second portion 24'' of holster hanger 24 into the holster body 22, cover portion 28'' is securely adhered onto the outer surface of stiffener portion 26'. Thereafter, when in position within and glued against the inner surface of inner side 32, second panel 48, with spacers 50 positioned as best seen in FIGS. 5 and 6, are positioned, glued and stitched along 42, 52 and 54 as best seen in FIG. 2 and 44 as best seen in FIG. 3 securely in position. In the preferred embodiment, a second thinner flexible inner layer 36 is also glued and stitched in position to completely cover the stiffener 26 and to form a continuous smooth uninterrupted surface against which the handgun placed within the holster body 24 comes in contact.

It should be here noted that the preferred material for fabricating the holster body 24 and cover 28 is leather. However, other synthetic materials such as naugahide, vinyl and the like may be utilized to fabricate holster assemblies in a broad range of prices.

Other portions 32' and 32'', glued and adhered against inner layer portions 36' and 36'' respectively, with intermediate portion 48' between portions 32' and 36' as best seen in FIG. 3, form the conventional upper handgun retaining segments which include two part snap portions 62 secured in place as shown to surround the appropriate portion of the handgun H for safety. Additionally, rivet 60 and stitching 58 secure the upper margins of portions 32', 48' and 36'.

One of the primary structural benefits provided by the present invention may now be more clearly understood by referring particularly to FIG. 3. The lower skirt S of any outer garment J worn by the user which extends below the belt B or waistband and hangs downwardly and outwardly therefrom is easily receivable into slot 40 which extends in its full width downwardly fully to the bottom of the U-section of holster hanger 24. It should be further made clear at this point that the slot 40 may extend virtually to the bottom of holster body 22 as desired by the user without sacrificing either slot 40 width or the secure and durable attachment between holster hanger 24 and holster body 22. An additional benefit of the present invention is that, for those officers who wish to have the holster body 22 positioned higher in relation to belt B, virtually no sacrifice of the depth or lower positioning of slot 40 in relation to belt B and skirt S is made for this feature of increased holster body 22 height.

Figure 9:
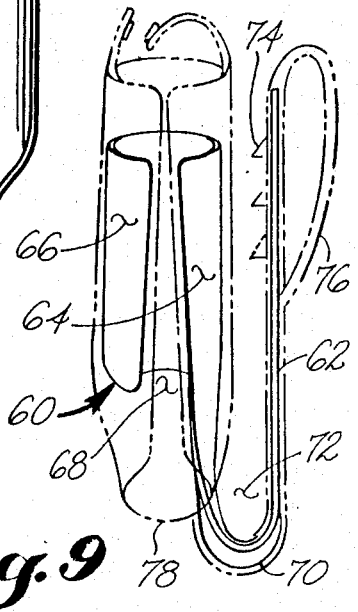
FIG. 9 is a front elevation view of the embodiment shown in FIG. 8.

Referring lastly to FIGS. 8 and 9, incorporating all of the structural and functional benefits as previously described, integral stiffener 60 is also provided which includes the additional feature of a resilient retention means for a front opening holster as previously described in the Background. This integrally formed stiffener 60 includes inner portion 64 which interengages within the inner side of the holster body as previously described. The bottom of the U-shaped cross section, along with portion 62 of stiffener 60, upwardly extends to mate with the flexible outer cover portion 76 (in phantom) to surround stiffener portion 62 and to form a belt loop and as previously described. The inner portion 64 in this embodiment 60 extends laterally around adding stiffener portion 66 to form slot 68 which, when covered with the holster body material 78, forms the front opening in the holster body for forwardly removal of the handgun as previously described in the Background. The embodiment 60 includes two additional features, one being downwardly and inwardly extending tabs 74, although not preferred, which assist in retaining the skirt of the upper jacket in the slot 72 and additionally includes stiffener ribs 70 in the bottom of the U-section to reinforce this portion of the stiffener 60.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A holster for a handgun comprising:

a holster body structured to receive the handgun, said holster body including an upper end, a lower end, an inner side having an exposed outer surface and a concealed inner surface;

said holster body inner side having a transverse elongated opening therethrough positioned adjacent its lower end;

a holster hanger having a rigid U-shaped contoured stiffener having an inner surface and an outer surface and a first leg, a bottom portion and a second leg;

said second leg of said stiffener extending into said inner side of said holster through said transverse elongated opening and connected to said inner surface of said holster body inner side;

a cover for said first leg and said bottom portion of said stiffener extending from said transverse elongated opening across said bottom portion of said inner surface of said stiffener, along said inner surface of said first leg of said stiffener, displaced from said outer surface of said stiffener a sufficient distance to form a belt loop having a top end, then along said outer surface of said first leg of said stiffener and across said bottom portion of said outer surface of said stiffener;

said bottom of said stiffener laterally extending from said elongated transverse opening to form an outer garment skirt receiving slot, one side of said slot formed by said covered first leg of said stiffener and the other side of said slot formed by said holster body inner side respectively;

said slot extending upwardly from said transverse opening to said top end of said belt loop;

said garment receiving slot extending along substantially the entire length of said holster hanger.

2. A holster as set forth in claim 1, wherein:

said holster hanger outer surface has smooth, uninterrupted surfaces.

3. A holster as set forth in claim 2, wherein said holster body inner side comprises:

a first layer of flexible material forming said outer surface;

a second layer of flexible material forming said inner surface;

said stiffener second leg disposed between said holster body first and second layers and secured thusly by adhesive means and by stitching through said holster body first and second layers and said cover second portion extending beyond said stiffener second portion.

4. A holster as set forth in claim 3, wherein said holster body inner side further comprises:

an intermediate layer of flexible material disposed between said holster body first and second layer;

said intermediate layer generally equal in thickness to said hanger inner surface and configured to fit around said hanger inner surface such that said holster body second layer is smooth and even.

5. A holster as set forth in claim 3, wherein said stiffener second leg further comprises:

a laterally extending contoured portion curving back to be spaced adjacent and opposing said stiffener second leg;

said stiffener portion also disposed between said holster body first and second layers and secured thusly by adhesive means;

said stiffener second leg and contoured portion acting in resilient cooperation with one another to form a front opening in said holster body, which opening is spring biased generally closed by said resilient cooperation between said stiffener second leg and contoured portion to retain the handgun in said holster body when not in use;

said opening expandable by forwardly manual pressure against the handgun to effect disengagement of the handgun from said holster body through said front opening.

6. A holster as set forth in claim 3, further comprising:

skirt retention means disposed in said slot for releasable engagement with the user's upper garment skirt when positioned in said slot.

7. A holster for a handgun comprising:

a holster body having an upper and a lower end and structured to receive the handgun, said holster body including an inner side having a concealed inner and an exposed outer surface;

said holster body inner side having a transverse elongated opening therethrough positioned adjacent its lower end;

a holster hanger having a rigid U-shaped contoured stiffener having a first leg having an upper end, a bottom portion and a second leg;

said second leg of said stiffener extending into said inner side of said holster through said transverse elongated opening and connected to said inner surface of said holster body inner side;

said holster hanger first leg having an elongated belt loop disposed downwardly from its upper end;

said bottom of said stiffener laterally extending from said elongated transverse opening to form an outer garment skirt receiving slot, one side of said slot formed by said first leg of said stiffener and the other side of said slot formed by said holster body inner side respectively;

said slot extending upwardly from said transverse opening to a top end of said belt loop;

said garment receiving slot extending along substantially the entire length of said holster hanger.

* * * * *